United States Patent [19]

Walch

[11] Patent Number: 4,527,598

[45] Date of Patent: Jul. 9, 1985

[54] CONTROL APPARATUS FOR A WEAVING MACHINE

[75] Inventor: Hansjörg Walch, Seuzach, Switzerland

[73] Assignee: Sulzer Brothers Limited, Winterthur, Switzerland

[21] Appl. No.: 543,169

[22] Filed: Oct. 19, 1983

[30] Foreign Application Priority Data

Nov. 8, 1982 [EP] European Pat. Off. ..... 82810473.7

[51] Int. Cl.[3] ..... D03D 41/00

[52] U.S. Cl. ..... 139/435; 139/450; 139/341; 139/370.2

[58] Field of Search ..... 139/11 R, 429, 450, 139/370.1, 370.2, 435, 341, 452

[56] References Cited

U.S. PATENT DOCUMENTS

| | | | |
|---|---|---|---|
| 4,270,579 | 6/1981 | Nakanishi | 139/370.2 |
| 4,415,008 | 11/1983 | Keller et al. | 139/435 |
| 4,421,143 | 12/1983 | Weidmann | 139/370.2 |
| 4,458,726 | 7/1984 | Wenig | 139/11 |

FOREIGN PATENT DOCUMENTS

| | | | |
|---|---|---|---|
| 632773 | 11/1978 | U.S.S.R. | 139/435 |

*Primary Examiner*—Henry S. Jaudon
*Attorney, Agent, or Firm*—Werner W. Kleeman

[57] ABSTRACT

Two sensors are arranged on the catch side of the weaving shed of the weaving machine. These two sensors scan the length of the weft-thread end which protrudes from the weaving shed beyond the catch side end thereof and define a range of reference or set values for the length of the protruding weft-thread end. When the front end of the weft-thread, upon standstill of the weft thread after the weft insertion operation, is located within the range of the reference or set values, there is not accomplished readjustment of the weft-thread brake. When the front end of the weft thread falls short or upstream of a first one of the two sensors which is placed close to the catch side end of the weaving shed, then the closure of the weft-thread brake is effected at a later moment of time during the next weft insertion operation. When the end of the weft-thread passes beyond or downstream of a second one of the two sensors which is placed further from the catch side end of the weaving shed, then the weft-thread brake is readjusted so as to close at an earlier moment of time. A minimum of weft-thread waste thus results and the ends of the weft thread always have substantially the same length.

20 Claims, 1 Drawing Figure

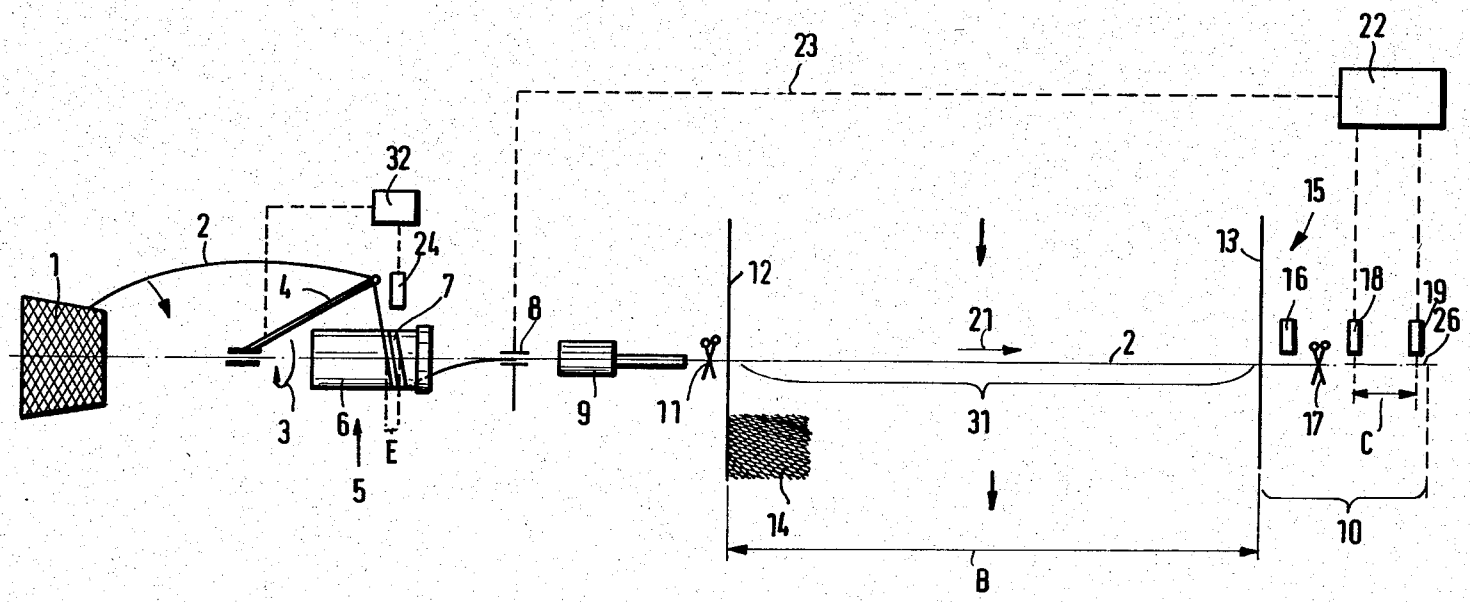
1
2
3
4
5
6
7
8
9
10
11
12
13
14
15
16
17
18
19
21
22
23
24
26
31
32
B
C
E

CONTROL APPARATUS FOR A WEAVING MACHINE

BACKGROUND OF THE INVENTION

The present invention broadly relates to weaving machines, and more specifically concerns itself with a new and improved apparatus for controlling the insertion of the weft thread in a weaving machine, especially, although not exclusively, a weaving machine working with air jet operated insertion means for the weft thread.

In a prior art weaving machine as known, for example, from German Patent Publication No. 3,002,862 published July 30, 1981, and the cognate copending U.S. application Ser. No. 226,542 filed Jan. 21, 1981, now U.S. Pat. No. 4,458,726 a sensor is arranged on the catch side of the weaving shed and senses the moment of time when the front end of the weft-thread arrives. In response thereto the weft insertion velocity at the related weft insertion mechanism is automatically increased or decreased by a control means depending upon whether the moment of time of arrival of the weft thread is too late or too early relative to a corresponding position of the main shaft of the weaving machine. In this arrangement there is also taken into account in conjunction with the weft insertion velocity the adjustment of the moment of time braking of the inserted weft thread by a weft-thread brake arranged on the weft insertion side of the weaving shed. Consequently, the moment of time of braking of the weft thread is shifted to an earlier moment of time simultaneously with the readjustment of the weft insertion velocity to a higher value, and conversely to a later moment of time simultaneously with the readjustment of the weft insertion velocity to a lower value.

Such arrangement has the disadvantage that the weft-thread ends which protrude from the weaving shed on the catch side thereof can have different lengths. When each of the weft-thread ends are cut-off at the weaving machine, there possibly arises a relatively large loss of weft-thread material. When the weft-thread ends, for example, are inwardly turned to form a weaving selvedge, such selvedge may possess a relatively large width in the presence of increased lengths of the weft-thread ends. It is possible for the width of the weaving selvedge to vary, for example, when the weft thread is infed or inserted by means of an air jet and the length of the infed weft threads is not always exactly the same.

SUMMARY OF THE INVENTION

Therefore, with the foregoing in mind it is a primary object of the present invention to provide a new and improved weaving machine which is not afflicted with such shortcomings.

Another important object of the present invention is concerned with an improved apparatus for controlling a weft-thread brake in a weaving machine which is not afflicted with the aforementioned drawbacks and limitations of the prior art constructions.

Still a further significant object of the present invention is to provide an improved construction of weaving machine equipped with structure for ensuring for a relatively constant length of the weft-thread ends protruding from the catch side of the weaving shed.

Now in order to implement these and still further objects of the invention, which will become more readily apparent as the description proceeds, the weaving machine of the present development is manifested by the features that, an apparatus is provided for controlling a weft-thread brake arranged on the weft side or weft insertion side of the weaving shed in response to the length of the weft-thread end which, after the weft insertion operation, protrudes from the weaving shed on the catch side thereof and which deviates from a predetermined reference or set value. In this manner the protruding weft-thread ends can be brought to possess substantially the same length. As a result there is attained the beneficial result that the loss of weft-thread material is small when the weft-thread ends are cut-off. There also can be thus produced a weaving selvedge of substantially constant width when the weft-thread ends should be inwardly turned, particularly in the case of an air jet operated weaving machine or loom.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE shows a schematic diagram of a weaving machine and associated control apparatus constructed according to the invention.

DETAILED DESCRIPTION OF THE PREFERRED EMBODIMENTS

Describing now the drawing, it is to be understood that only enough of the construction of the weaving machine has been shown as needed for those skilled in the art to readily understand the underlying principles and concepts of the present development, while simplifying the showing of the drawing. Turning attention now specifically to the single FIGURE of the drawing, there has been schematically illustrated therein a weaving machine or loom comprising a stationarily arranged weft-thread supply spool or bobbin 1 from which a weft thread 2 is withdrawn and wound-up upon a stationary, non-rotating winding drum 6 by means of a winding-up or winder arm 4 of a weft-thread storage member or storage 5. The winding-up arm 4 rotates in the direction of the arrow 3. Weft-thread turns or coils 7 are thus stored at the surface of the winding drum 6. These weft-thread turns or coils 7 are withdrawn towards the right of the showing of the drawing during each weft insertion insertion operation and during this insertion operation the weft thread 2 passes through an adjustable weft-thread brake 8 and an infeed or insertion nozzle 9 which are arranged on the weft insertion side of a weaving shed 31.

The storage member 5 contains a suitable sensing member or sensor 24 and control member 32 which are conventional and therefore not shown in any particular detail. The sensing member 24 and the control member 32 enable the axial length of the winding formed by the weft-thread turns or coils 7 to be regulated in such a manner that, for example, with too large a length E the winding-up arm 4 is stopped while the same is again driven when the length E is too small.

The weft infeed or insertion nozzle 9 is appropriately supplied with air from a suitable compressed air source in accordance with the weft-thread infeed or insertion cycles of the weaving machine. During the weft insertion operation the weft thread 2, after leaving the weft infeed or insertion nozzle 9, passes through a cutting device 11 into the weaving shed 31 at the weft insertion side or starting end 12 thereof along an infeed or insertion path in a direction indicated by the arrow 21. In the single FIGURE of the drawing the weaving or cloth width is designated by reference character B, the catch side end of the weaving shed 31 by reference character 13 and the fabricated woven material or cloth by reference character 14.

On the catch side 15 of the weaving shed 31 the weft thread 2 first passes a first sensing member or sensor 16, a cut-off means or cutter 17 and subsequently two further sensors 18 and 19. The sensing member 16 forms the scanner or feeler of a weft-thread monitoring device by means of which the presence of the weft thread 2 on the catch side 15 of the weaving shed 31 is sensed. When the weft thread 2 does not arrive at the sensing member 16, the weaving machine is stopped by such sensing member or sensor 16.

The two sensors 18 and 19 are successively arranged in the weft infeed or insertion direction 21. These two sensors 18 and 19 are part of the control arrangement for controlling the weft-thread brake 8 located on the weft insertion side 12 of the weaving shed 31. The control arrangement or control means further includes a suitable control or regulator 22 to which the two sensors 18 and 19 are connected and which, in turn, is connected to the weft-thread brake 8 via a control line 23. Controls for operating a thread brake as such are known to the art, for instance, from U.S. Pat. No. 3,563,281, granted Feb. 16, 1971, and Belgian Pat. No. 890,228, dated Jan. 4, 1982, to which reference may be readily had. The two sensors 18 and 19 are spaced from each other by a distance designated by reference character C. This distance or spacing C defines a range of reference or set values for the desired position of the front or leading end 26 of the weft thread 2 after completion of the weft insertion operation, i.e. upon standstill of the infed weft thread 2. The length of the weft-thread end which protrudes from the weaving shed 31 on the catch side 15 thereof is designated by reference character 10.

In the case of a somewhat too weak air current it may occur during the weft insertion operation that the weft thread 2 which is inserted by the action of the weft infeed or insertion nozzle 9 only passes through the weaving shed 31 to such an extent so as to approximately just reach the cut-off device or cutter 17. The weft-thread end 10 thus falls short of the two sensors 18 and 19 and does not move past the same. The absence of the weft-thread end 10 is signalled to the control or regulator 22 by the one sensor 18 and by means of such control or regulator 22 the moment of closing of the weft-thread brake 8 is readjusted via the control line 23 to a later moment of time for the next-following weft insertion operation. In this way there is ensured that the front or leading end 26 of the weft thread 2 reaches a position between the two sensors 18 and 19, i.e. within the range C of reference or set values, during the next-following weft insertion operation.

Conversely, when the front or leading end 26 of the weft thread 2, for example, reaches the other sensor 19 or passes beyond of the same, this sensor 19 supplies a signal to the control or regulator 22, whereby the moment of closing of the weft-thread brake 8 is readjusted to an earlier moment of time for the next-following weft insertion operation. Thus, during the next-following weft insertion operation the front or leading end 26 of the weft thread 2 again comes to standstill between the two sensors 18 and 19, i.e. within the range C of the reference or set values.

The reference or set value range C can be adjusted to a relatively small range by displacing the two sensors 18 and 19 close to each other. In this way a substantially constant length of the weft-thread ends 10 can be achieved. Both of the sensors 18 and 19 also can be placed close to the cut-off means 17, so that the length of the weft-thread ends 10, and thus, the waste of weft-thread material can be maintained rather small.

The control apparatus as described hereinbefore and designed for automatic adjustment of the closure moment of the weft-thread brake 8 also can be utilized with other kinds of weaving machines or looms such as, for example, a rapier or gripper weaving machine. In such a weaving machine the weft thread is inserted into the weaving shed by means of two rigid rapiers or gripper tapes or rods instead of the air infeed nozzle 9.

According to a further aspect of the invention two sensors 18 and 19 can act to vary the braking intensity or the braking force exerted by the weft-thread brake 8, namely in such a manner that the braking force is increased for the next-following weft insertion operation when the front or leading end 26 of the weft thread 2 reaches or passes the sensor 19. Conversely, the braking force of the weft-thread brake 8 is reduced for the next-following weft insertion operation when the front or leading end 26 of the weft thread 2 falls short or upstream of the sensor 18. The next-following weft insertion operation thus can be again performed in such a manner that the front end 26 of the weft thread 2 comes to a standstill at the end of the weft insertion operation intermediate the two sensors 18 and 19, i.e. within the range C of the reference or set values.

The automatic control means as described hereinbefore need not contain a comparator or trigger of the type which possibly only operates within a predetermined angular range of the main shaft of the weaving machine. Quite to the contrary, the control of regulating arrangement or apparatus 18, 19, 22 can operate without such a comparator or trigger, and thus, independent of the instantaneous position of the main shaft of the weaving machine. The reason therefor is that only the length of the weft-thread end 10 which protrudes beyond the catch side end 13 of the weaving shed 31 is sensed by the two sensors 18 and 19, particularly with respect to whether the front end 26 of the weft thread 2 comes to standstill within the range C defining the range of reference or set values. Such sensing or scanning operation can be conducted independently of the associated angular range of the main shaft of the weaving machine. The two sensors 18 and 19 can be maintained active during the entire operating cycle of the weaving machine so that these two sensors 18 and 19 are continuously ready for performing their weft sensing or scanning operation.

Instead of the two sensors 18 and 19 which are connected to the control or regulator 22 more than two, for example, three or four successively arranged sensors or feelers can be employed for sensing or scanning the stationary weft-thread end 10. This arrangement may be perfected such that, for example, for the alternating insertion of different types of weft-threads 2 a first pair of sensors is used to define the range of reference or set values for a first type of weft thread, while a second pair of sensors is used to define the range of reference or set values for a second type of weft thread.

The cut-off means 17 may be possibly omitted, in particular in the case of weaving machines containing insertion ledges or the like for inwardly turning or tucking the weft-thread ends 10 in order to form a weaving or cloth selvedge from the entire protruding weft-thread end following a weaving shed change.

While there are shown and described present preferred embodiments of the invention, it is to be distinctly understood that the invention is not limited thereto, but may be otherwise variously embodied and practiced within the scope of the following claims.

Accordingly, what I claim is:

1. A weaving machine containing insertion means for a weft thread, comprising:

a weaving shed defining a weft insertion side and a catch side;

a weft-thread brake arranged on said weft side of said weaving shed;

control means operatively connected to said weft-thread brake for controlling said weft thread brake in response to an end of said weft thread which protrudes from said catch side of said weaving shed at the end of the insertion of said weft thread;

means defining a reference value for said end of said weft thread protruding from said catch side of said weaving shed; and said control means controlling, in response to deviations of said end of said weft thread from said reference value, the actuation of said weft-thread brake such that said end of said weft thread protruding from said catch side of said weaving shed is substantially maintained at a predetermined length set by said reference value defining means.

2. The weaving machine as defined in claim 1, wherein:

said weaving shed defines an insertion path for said weft-thread;

said means defining said reference value comprises two sensors successively arranged along an extension of said insertion path on said catch side of said weaving shed;

said control means comprising a regulator operatively connected to said weft-thread brake; and said sensors being arranged to define a range of said reference values and being connected to said regulator for automatically controlling said weft-thread brake.

3. The weaving machine as defined in claim 2, wherein:

said weft-thread brake is adjustable in order to close at a selectable moment of time;

said closing of said weft-thread brake being controlled by said regulator and occurring at a preselected moment of time;

a first one of said two sensors being arranged to define a first limiting reference value of said range of reference values, so that said weft-thread brake is closed at a later moment of time than said preselected moment of time when said end of said weft-thread falls short of said first sensor; and a second one of said two sensors being arranged to define a second limiting reference value of said range of reference values, so that said weft-thread brake is closed at an earlier moment of time than said preselected moment of time when said end of said weft-thread passes beyond said second sensor.

4. The weaving machine as defined in claim 2, wherein:

said weft-thread brake is adjustable in order to operate at a selectable braking force;

said weft-thread brake being controlled by said regulator and operating at a preselected braking force;

a first one of said two sensors being arranged to define a first limiting reference value of said range of reference values, so that said weft-thread brake is operated at a lower braking force than said preselected braking force when said end of said weft-thread falls short of said first sensor; and a second one of said two sensors being arranged to define a second limiting reference value of said range of reference values, so that said weft-thread brake is operated at a higher braking force than said preselected braking force when said end of said weft-thread passes beyond said second sensor.

5. The weaving machine as defined in claim 2, further including:

a monitoring sensor for monitoring the presence of said weft thread on the catch side of said weaving shed; and said monitoring sensor being precedingly arranged of said two successively arranged sensors in said weft-thread insertion path.

6. The weaving machine as defined in claim 1, further including:

monitoring means for monitoring the presence of the weft thread on the catch side of said weaving shed.

7. An apparatus for controlling a weft-thread brake in a weaving machine including a weaving shed defining a weft insertion side, on which said weft-thread brake is arranged, and a catch side, a weft thread being insertable through the weaving shed along a predetermined weft insertion path, comprising:

control means operatively connected to said weft-thread brake to control the same in response to an end of said weft thread which protrudes from said catch side of said weaving shed at the end of the insertion of said weft thread;

means defining a reference value for said end of said weft thread protruding from said catch side of said weaving shed; and said control means controlling, in response to deviations of said end of said weft thread from said reference value, said weft-thread brake such that said end of said weft thread protruding from said catch side of said weaving shed is substantially maintained at a predetermined length set by said reference value defining means.

8. The apparatus as defined in claim 7, wherein:

said means defining said reference value comprises two sensors successively arranged along an extension of said weft insertion path on said catch side of said weaving shed;

said control means comprising a regulator operatively connected to said weft-thread brake; and said two sensors being positioned to define a range of reference values and being connected to said regulator for automatically controlling said weft-thread brake.

9. The apparatus as defined in claim 8, wherein:

said weft-thread brake is adjustable so as to operate at a selectable braking force;

said weft-thread brake being controlled by said regulator and operating at a preselected braking force;

a first one of said two sensors being arranged to define a first limiting reference value of said range of reference values, so that said weft-thread brake is operated at a lower braking force than said preselected braking force when said end of said weft thread is located upstream of said first sensor; and a second one of said two sensors being arranged to define a second limiting reference value of said range of reference values, so that said weft-thread brake is operated at a higher braking force than said preselected braking force when said end of weft thread passes beyond and downstream of said second sensor.

10. The weaving machine as defined in claim 8, further including:

a monitoring sensor for monitoring the presence of said weft thread on the catch side of said weaving shed; and said monitoring sensor being precedingly arranged of said two successively arranged sensors in said weft-thread insertion path.

11. The apparatus as defined in claim 7, wherein:

said weft-thread brake is adjustable so as to close at a selectable moment of time;

said closing of said weft-thread brake being controlled by said regulator and occurring at a preselected moment of time;

a first one of said two sensors being arranged to define a first limiting reference value of said range of reference values, so that said weft-thread brake is closed at a later moment of time than said predetermined moment of time when said end of said weft thread is located upstream of said first sensor; and a second one of said two sensors being arranged to define a second limiting reference value of said range of reference values, so that said weft-thread brake is closed at an earlier moment of time than said preselected moment of time when said end of weft thread passes beyond and downstream of said second sensor.

12. The weaving machine as defined in claim 7, further including:

monitoring means for monitoring the presence of the weft thread on the catch side of said weaving shed.

13. A weaving machine containing jet operated insertion means for a weft thread, comprising:

a weaving shed defining a weft insertion side and a catch side;

a weft-thread brake arranged on said weft side of said weaving shed;

control means operatively connected to said weft-thread brake and controlling the moment of actuation of said weft thread brake as a function of an end of said weft thread which protrudes from said catch side of said weaving shed at the end of the insertion of said weft thread;

means defining a reference value for said end of said weft thread protruding from said catch side of said weaving shed; and said control means responding to deviations of said end of said weft thread from said reference value.

14. A method of controlling the weft thread insertion in a weaving machine comprising weft thread insertion means, an adjustable weft thread brake and a weaving shed defining a weft thread insertion side and a catch side, said method comprising the steps of:

inserting the weft thread by means of said weft thread insertion means into the weaving shed on the weft thread insertion side thereof and passing the weft thread by means of said weft thread insertion means along a predetermined weft thread insertion path such that an end of the weft thread protrudes from said weaving shed on the catch side thereof;

setting a reference value corresponding to a predetermined protruding length of said weft thread end on the catch side of said weaving shed;

detecting said protruding length of said weft thread end on the catch side of said weaving shed;

controlling the actuation of said adjustable weft thread brake in response to the detection of said predetermined protruding length of said weft thread end on the catch side of said weaving shed;

detecting deviations of said protruding length of said weft thread end from said predetermined protruding length thereof; and controlling the actuation of said adjustable weft thread brake in response to the detection of said deviations from the predetermined protruding length of said protruding length of the weft thread end on the catch side of said weaving shed such that said adjustable weft thread brake is readjusted in order to substantially maintain said predetermined protruding length of said weft thread on the catch side of said weaving shed.

15. The method as defined in claim 14, further including the step of:

monitoring the presence of said weft thread on the catch side of said weaving shed prior to the step of detecting said protruding length of said weft thread end on the catch side of said weaving shed.

16. The method as defined in claim 14, wherein:

said step of setting said reference value of the protruding length of said weft thread end on the catch side of said weaving shed includes the step of successively arranging two sensors along said predetermined weft thread insertion path on the catch side of said weaving shed;

connecting a regulator for controlling said actuation of said adjustable weft thread brake to said two sensors on an input side of said regulator;

connecting said regulator on an output side thereof to said adjustable weft thread brake; and said step of controlling the actuation of said adjustable weft thread brake including the step of regulating the actuation of said adjustable weft thread brake by means of said regulator.

17. The method as defined in claim 16, further including the step of:

placing a monitoring sensor such as to precede said two successively arranged sensors in said predetermined weft thread insertion path; and monitoring the presence of said weft thread on the catch side of said weaving shed by means of said monitoring sensor.

18. The method as defined in claim 16, wherein:

said step of arranging said two sensors on the catch side of said weaving shed includes the step of arranging a first one of said two sensors such as to define a first limiting reference value of a range of values of the predetermined protruding length of said weft thread end;

said step of detecting said deviations of said protruding length of said weft thread end on the catch side of said weaving shed from said predetermined protruding length thereof including the step of detecting, by means of said first sensor, a protruding length of said weft thread end which is smaller than said first limiting reference value of said range of values of the predetermined protruding length of said weft thread end;

said step of arranging said two sensors on the catch side of said weaving shed further including the step of arranging a second one of said two sensors such as to define a second limiting reference value of said range of values of the predetermined protruding length of said weft thread end; and said step of detecting said deviation of said protruding length of said weft thread end on the catch side of said weaving shed from said predetermined protruding length thereof including the step of detecting, by means of said second sensor, a protruding length of said weft thread end which is greater than said second limiting reference value of said range of predetermined values of the predetermined protruding length of said weft thread end.

19. The method as defined in claim 16, further including the steps of:

adjusting said adjustable weft thread brake for closing at a selectable moment of time;

said step of controlling the actuation of said adjustable weft thread brake in response to the detection of said predetermined protruding length of said weft thread end on the catch side of said weaving shed including the step of adjusting said adjustable weft thread brake for closing at a preselected moment of time;

said step of controlling the actuation of said adjustable weft thread brake in response to the detection of said deviation of said protruding length of said weft thread end on the catch side of said weaving shed from said predetermined protruding length thereof including the step of re-adjusting said adjustable weft thread brake for closing at a later moment of time than said preselected moment of time when said protruding length of said weft thread end is smaller than said first limiting reference value of said range of predetermined values of said protruding length of said weft thread end; and said step of controlling the actuation of said adjustable weft thread brake in response to the detection of said deviation of said protruding length of said weft thread end on the catch side of said weaving shed from said predetermined protruding length including the step of re-adjusting said adjustable weft thread brake for closing at an earlier moment of time than said preselected moment of time when said protruding length of said weft thread end is greater than said second limiting reference value of said range of predetermined values of the protruding length of said weft thread end.

20. The method as defined in claim 16, further including the steps of:

adjusting said adjustable weft thread brake for operation at a selectable braking force;

said step of controlling the actuation of said adjustable weft thread brake in response to the detection of said predetermined protruding length of said weft thread end on the catch side of said weaving shed including the step of adjusting said adjustable weft thread brake for operation at a preselected braking force;

said step of controlling the actuation of said adjustable weft thread brake in response to the detection of said deviations of said protruding length of said weft thread end on the catch side of said weaving shed from said predetermined protruding length thereof including the step of re-adjusting said adjustable weft thread brake for operation at a smaller braking force than said preselected braking force when said protruding length of said weft thread end is smaller than said first limiting reference value of said range of predetermined values of the protruding length of said weft thread end; and said step of controlling the actuation of said adjustable weft thread brake in response to the detection of said deviations of said protruding length of said weft thread end on the catch side of said weaving shed from said predetermined protruding length thereof including the step of re-adjusting said adjustable weft thread brake for operation at a greater braking force than said preselected braking force when said protruding length of said weft thread end is greater than said second limiting reference value of said range of predetermined values of the protruding length of said weft thread end.

* * * * *